US011179593B2

(12) United States Patent
Shah

(10) Patent No.: US 11,179,593 B2
(45) **Date of Patent: *Nov. 23, 2021**

(54) EXERCISE DEVICE

(71) Applicant: Recovery Science LLC, Rockville, MD (US)

(72) Inventor: Shalin N. Shah, Rockville, MD (US)

(73) Assignee: RECOVERY SCIENCE LLC, Rockville, MD (US)

( * ) Notice: Subject to any disclaimer, the term of this patent is extended or adjusted under 35 U.S.C. 154(b) by 112 days.

This patent is subject to a terminal disclaimer.

(21) Appl. No.: 16/580,216

(22) Filed: Sep. 24, 2019

(65) Prior Publication Data

US 2020/0016447 A1 Jan. 16, 2020

Related U.S. Application Data

(63) Continuation of application No. 15/498,252, filed on Apr. 26, 2017, now Pat. No. 10,441,839, which is a (Continued)

(51) Int. Cl.
*A63B 21/075* (2006.01)
*A63B 60/04* (2015.01)
(Continued)

(52) U.S. Cl.
CPC ..... *A63B 21/075* (2013.01); *A61H 1/0274* (2013.01); *A63B 15/00* (2013.01);
(Continued)

(58) Field of Classification Search
CPC .... A61H 1/0274; A63B 15/00; A63B 15/005; A63B 21/0004; A63B 21/00058;
(Continued)

(56) References Cited

U.S. PATENT DOCUMENTS 2,470,816 A * 5/1949 Roosevelt ..... A63B 15/00 482/109
2,921,791 A 1/1960 Berne
(Continued)

FOREIGN PATENT DOCUMENTS

JP 2006-116304 5/2006
KR 20-0285657 8/2002

OTHER PUBLICATIONS

Non-final Office Action U.S. Appl. No. 13/268,133 dated Sep. 5, 2013.

(Continued)

*Primary Examiner* — Gary D Urbiel Goldner

(74) *Attorney, Agent, or Firm* — Pillsbury Winthrop Shaw Pittman, LLP

(57) ABSTRACT

In general, an exercise device includes a handle having a first end and a second end. A curved member is coupled to the first end of the handle. A movable member is coupled to the curved member, with the movable member configured to travel along a length of the curved member, where the movable member has a first portion and a second portion, and the second portion is configured to move relative to the first portion. An elongate member has a first end and a second end, and the first end of the elongate member is coupled to the second portion of the movable member. A weight is coupled to the second end of the elongate member.

20 Claims, 8 Drawing Sheets

Related U.S. Application Data continuation of application No. 14/830,967, filed on Aug. 20, 2015, now Pat. No. 9,895,570, which is a continuation of application No. 14/585,583, filed on Dec. 30, 2014, now Pat. No. 9,126,080, which is a continuation of application No. 13/268,133, filed on Oct. 7, 2011, now Pat. No. 9,028,378.

(60) Provisional application No. 61/391,528, filed on Oct. 8, 2010.

(51) Int. Cl.

| | |
|---|---|
| ***A63B 21/00*** | (2006.01) |
| ***A63B 21/062*** | (2006.01) |
| ***A63B 69/38*** | (2006.01) |
| ***A63B 71/06*** | (2006.01) |
| ***A61H 1/02*** | (2006.01) |
| ***A63B 23/12*** | (2006.01) |
| ***A63B 23/14*** | (2006.01) |
| ***A63B 24/00*** | (2006.01) |
| ***G05G 1/10*** | (2006.01) |
| ***A63B 15/00*** | (2006.01) |
| ***A63B 60/34*** | (2015.01) |
| ***A63B 21/072*** | (2006.01) |
| ***A63B 23/16*** | (2006.01) |
| ***A63B 69/36*** | (2006.01) |
| ***A63B 21/002*** | (2006.01) |
| ***A63B 21/005*** | (2006.01) |
| ***A63B 43/02*** | (2006.01) |
| ***A63B 60/00*** | (2015.01) |

(52) U.S. Cl.

CPC ..... *A63B 15/005* (2013.01); *A63B 21/00065* (2013.01); *A63B 21/00069* (2013.01); *A63B 21/00072* (2013.01); *A63B 21/00178* (2013.01); *A63B 21/00196* (2013.01); *A63B 21/0624* (2015.10); *A63B 21/072* (2013.01); *A63B 21/4035* (2015.10); *A63B 23/12* (2013.01); *A63B 23/1281* (2013.01); *A63B 23/14* (2013.01); *A63B 23/16* (2013.01); *A63B 24/0087* (2013.01); *A63B 60/04* (2015.10); *A63B 60/34* (2015.10); *A63B 69/36* (2013.01); *A63B 69/38* (2013.01); *A63B 71/0622* (2013.01); *G05G 1/10* (2013.01); *A63B 21/0023* (2013.01); *A63B 21/0058* (2013.01); *A63B 43/02* (2013.01); *A63B 60/0085* (2020.08); *A63B 69/3623* (2013.01); *A63B 69/3676* (2013.01); *A63B 2024/0096* (2013.01); *A63B 2071/0602* (2013.01); *A63B 2071/063* (2013.01); *A63B 2071/0655* (2013.01); *A63B 2071/0694* (2013.01); *A63B 2210/50* (2013.01); *A63B 2220/10* (2013.01); *A63B 2220/40* (2013.01); *A63B 2225/09* (2013.01)

(58) Field of Classification Search

CPC ..... A63B 21/00061; A63B 21/00065; A63B 21/00069; A63B 21/00072; A63B 21/00076; A63B 21/00178; A63B 21/00181; A63B 21/00185; A63B 21/00196; A63B 21/002; A63B 21/0023; A63B 21/005; A63B 21/0058; A63B 21/0608; A63B 21/062; A63B 21/0622; A63B 21/0624; A63B 21/0626; A63B 21/0628; A63B 21/063; A63B 21/0632; A63B 21/068; A63B 21/072; A63B 21/075; A63B 21/08; A63B 21/15; A63B 21/159; A63B 21/22; A63B 21/4023; A63B 21/4027; A63B 21/4033; A63B 21/4035; A63B 21/4039; A63B 21/4041; A63B 21/4043; A63B 21/4045; A63B 21/4047; A63B 21/4049; A63B 23/12; A63B 23/1209; A63B 21/1245; A63B 21/1281; A63B 21/14; A63B 21/16; A63B 24/0087; A63B 2024/0096; A63B 60/0085; A63B 60/02; A63B 60/04; A63B 60/06; A63B 60/34; A63B 69/0002; A63B 69/0015; A63B 69/0017; A63B 69/36; A63B 69/3623; A63B 69/3676; A63B 69/38; A63B 2069/0004; A63B 2069/0008; A63B 71/0054; A63B 71/0619; A63B 71/0622; A63B 2071/0063; A63B 2071/0072; A63B 2071/0081; A63B 2071/0602; A63B 2071/063; A63B 2071/0655; A63B 2071/0694; A63B 2210/00; A63B 2210/50; A63B 2220/10; A63B 2220/40; A63B 2225/09; A63B 2225/093

See application file for complete search history.

(56) References Cited

U.S. PATENT DOCUMENTS

| | | | | | |
|---|---|---|---|---|---|
| 3,019,019 | A | | 1/1962 | Forte | |
| 3,294,399 | A | | 12/1966 | Cugliari | |
| 3,351,346 | A | | 11/1967 | Strahan | |
| 3,414,260 | A | | 12/1968 | Gust | |
| 3,502,329 | A | * | 3/1970 | Brazier | A63B 21/4015 482/109 |
| 3,545,121 | A | * | 12/1970 | Misko | A63B 21/4043 446/486 |
| 3,703,294 | A | | 11/1972 | Fitch | |
| 3,874,660 | A | | 4/1975 | Brethen | |
| 4,027,879 | A | * | 6/1977 | Wright | A63B 69/38 473/464 |
| 4,229,002 | A | | 10/1980 | Masters | |
| 4,249,762 | A | | 2/1981 | Richards | |
| 4,345,756 | A | | 8/1982 | Hoagland | |
| 4,373,717 | A | | 2/1983 | Lambert | |
| 4,381,111 | A | | 4/1983 | Richards | |
| 4,411,423 | A | | 10/1983 | Estwanik | |
| 4,580,778 | A | | 4/1986 | Van Noord | |
| 4,627,618 | A | | 12/1986 | Schwartz | |
| 4,682,775 | A | | 7/1987 | Wood | |
| 4,863,161 | A | | 9/1989 | Telle | |
| 4,909,505 | A | | 3/1990 | Tee | |
| 5,039,091 | A | | 8/1991 | Johnson | |
| 5,050,875 | A | | 9/1991 | Lewkovich | |
| 5,060,933 | A | | 10/1991 | Cedro | |
| 5,080,350 | A | | 1/1992 | Schofield | |
| 5,087,031 | A | | 2/1992 | Hoff | |
| 5,195,748 | A | | 3/1993 | Koch | |
| 5,209,481 | A | | 5/1993 | Deback | |
| 5,242,344 | A | | 9/1993 | Hundley | |
| 5,281,192 | A | | 1/1994 | Nelson | |
| 5,308,303 | A | | 5/1994 | Rawls | |
| 5,312,309 | A | | 5/1994 | Fox | |
| 5,380,261 | A | | 1/1995 | Mora | |
| 5,496,240 | A | | 3/1996 | Damm | |
| 5,538,245 | A | * | 7/1996 | Moore | A63B 53/047 473/239 |
| 5,599,021 | A | | 2/1997 | Lary | |
| 5,788,607 | A | | 8/1998 | Baker | |
| 5,788,608 | A | * | 8/1998 | Wilkinson | A63B 21/0724 482/51 |
| 5,888,146 | A | | 3/1999 | Raynak | |
| 6,022,299 | A | | 2/2000 | Stewart | |
| 6,132,343 | A | | 10/2000 | Eze | |
| 6,152,858 | A | | 11/2000 | Kolb | |
| 6,402,633 | B1 | | 6/2002 | Hsiung | |

(56) References Cited

U.S. PATENT DOCUMENTS

| | | | | |
|---|---|---|---|---|
| 6,443,874 | B1 | 9/2002 | Bennett | |
| 6,939,276 | B2 | 9/2005 | Gates | |
| 7,104,934 | B1 | 9/2006 | Smith | |
| 7,152,471 | B2 | 12/2006 | Baratz | |
| 7,278,958 | B2 | 10/2007 | Morgan | |
| 7,303,507 | B1 | 12/2007 | Jozsa | |
| 7,476,183 | B1 | 1/2009 | Chrest | |
| 7,537,552 | B2 | 5/2009 | Dalebout | |
| 7,828,703 | B1 | 11/2010 | Boesch | |
| 7,976,441 | B2 | 7/2011 | Ellis | |
| 8,936,536 | B2 | 1/2015 | Detterberg | |
| 9,028,378 | B2 * | 5/2015 | Shah | A63B 69/36 482/109 |
| 9,126,080 | B2 * | 9/2015 | Shah | A63B 21/072 |
| 9,895,570 | B2 * | 2/2018 | Shah | A63B 21/00065 |
| 10,441,839 | B2 * | 10/2019 | Shah | A63B 69/38 |
| 2002/0072455 | A1 | 6/2002 | Akins | |
| 2003/0004041 | A1 | 1/2003 | Hartman | |
| 2003/0190999 | A1 | 10/2003 | Liu | |
| 2004/0180764 | A1 | 9/2004 | Patton | |
| 2005/0143230 | A1 | 6/2005 | Dalebout | |
| 2006/0040799 | A1 | 2/2006 | Pompile | |
| 2006/0128534 | A1 | 6/2006 | Roque | |
| 2006/0281609 | A1 | 12/2006 | Shah | |
| 2007/0054785 | A1 | 3/2007 | Drechsler | |
| 2007/0123398 | A1 | 5/2007 | Ljevaja | |
| 2007/0135273 | A1 | 6/2007 | Ljevaja | |
| 2007/0161472 | A1 | 7/2007 | Drechsler | |
| 2008/0139332 | A1 | 6/2008 | Nelson | |
| 2010/0029447 | A1 | 2/2010 | Song | |
| 2010/0113234 | A1 | 5/2010 | Kristiansen | |
| 2010/0144501 | A1 | 6/2010 | Berhanu | |
| 2011/0098155 | A1 | 4/2011 | Lemos | |
| 2011/0190100 | A1 | 8/2011 | Liu | |
| 2012/0035512 | A1 | 2/2012 | Su | |
| 2012/0083391 | A1 | 4/2012 | Dooney | |
| 2012/0196729 | A1 | 8/2012 | Rafaeli | |
| 2015/0119209 | A1 * | 4/2015 | Shah | A63B 21/4035 482/93 |
| 2016/0107019 | A1 * | 4/2016 | Shah | A63B 21/00069 482/93 |
| 2017/0225026 | A1 * | 8/2017 | Shah | A63B 21/075 |

OTHER PUBLICATIONS

Notice of Allowance U.S. Appl. No. 13/268,133 dated Jun. 6, 2014.
Office Action issued in EP Application No. 11831663.7 dated Nov. 28, 2014.
Mark O'Meara, Instructional Manual, Medicus Dual Hinge Drive, "Drive Like a Pro", Copyright 2004, RM&G Products, Carlsbad CA, 9 pgs.
Notice of Allowance U.S. Appl. No. 15/498,252 dated Jun. 10, 2019.
Non-final Office Action U.S. Appl. No. 11/440,062 dated Jul. 10, 2007.
Final Office Action U.S. Appl. No. 11/440,062 dated Dec. 12, 2007.
Non-final Office Action U.S. Appl. No. 11/440,062 dated Oct. 1, 2008.
Final Office Action U.S. Appl. No. 11/440,062 dated Apr. 24, 2009.
Non-final Office Action U.S. Appl. No. 11/440,062 dated Oct. 28, 2010.
Final Office Action U.S. Appl. No. 11/440,062 dated May 25, 2011.
PCT Notification of Transmittal of the International Search Report and Written Opinion for International Application No. PCT/US2011/055224 dated May 14, 2012.
PCT International Preliminary Report on Patentability for International Application No. PCT/US2011/055224 dated Apr. 9, 2013.
Office Action Japanese Patent Application No. 2013-532968 (English Translation Only).
Notice of Allowance U.S. Appl. No. 14/585,583 dated May 5, 2015.
Office Action Australian Patent Application No. 2011311843 dated Mar. 18, 2016 with English translation.
Office Action Taiwan Patent Application No. 100136588 dated Jan. 21, 2016 with English translation.
Office Action European Patent Application No. 11 831 663.7 dated Sep. 8, 2016.
Non-final Office Action U.S. Appl. No. 15/498,252 dated Jan. 15, 2019.
Notice of Allowance U.S. Appl. No. 14/830,967 dated Oct. 12, 2017.
Notification of Reasons for Refusal Japanese Patent Application No. 2016-234695 dated Sep. 26, 2017 with English translation.
Office Action European Patent Application No. 11 831 663.7 dated May 16, 2017.
Notice of Allowance Korean Patent Application No. 10-2013-7011846 dated Jan. 22, 2018 with English translation.

* cited by examiner

EXERCISE DEVICE

CROSS-REFERENCE TO RELATED APPLICATIONS

This application is a Continuation of U.S. application Ser. No. 15/498,252, filed Apr. 26, 2017, which is a Continuation of U.S. application Ser. No. 14/830,967, filed Aug. 20, 2015, now U.S. Pat. No. 9,895,570, issued Feb. 20, 2018, which is a Continuation of U.S. application Ser. No. 14/585,583, filed Dec. 30, 2014, now U.S. Pat. No. 9,126,080, issued Sep. 8, 2015, which is a continuation of U.S. application Ser. No. 13/268,133, filed Oct. 7, 2011, now U.S. Pat. No. 9,028,378, issued May 12, 2015, which claims priority to and the full benefit of U.S. Provisional Application Ser. No. 61/391,528, filed Oct. 8, 2010, and entitled "Exercise Device". The entire contents of each of the above are incorporated herein by reference.

TECHNICAL FIELD

This document generally describes exercise devices.

BACKGROUND

Individuals can greatly improve the strength and coordination of their hands, wrists, and arms through exercise with appropriate resistance. In addition, individuals with injuries to the hands, wrists, or arms can accelerate rehabilitation by exercising with appropriate resistance.

SUMMARY

In one general aspect, an exercise device includes a handle having a first end and a second end; a curved member coupled to the first end of the handle; a movable member coupled to the curved member, with the movable member configured to travel along a length of the curved member, and the movable member having a first portion and a second portion, the second portion being configured to move relative to the first portion; an elongate member having a first end and a second end, the first end of the elongate member being coupled to the second portion of the movable member; and a weight coupled to the second end of the elongate member.

Implementations may include one or more of the following features. For example, the curved member is curved along the length of the curved member. The length of the curved member extends from the first end of the handle toward the second end of the handle. The second end of the curved member is positioned approximately halfway between the first end and the second end of the handle. The first end of the curved member is coupled to the first end of the handle and the second end of the curved member is free. The moveable portion can be configured to move in a direction generally perpendicular to the length of the curved member.

Implementations may also include one or more of the following features. For example, the handle defines a longitudinal axis between the first end and the second end of the handle, the curved member defines a longitudinal axis between the first end and the second end of the curved member, the longitudinal axis of the handle and the longitudinal axis of the curved member defines a plane, and the moveable portion is configured to move the weight out of the plane. The rod can be positioned perpendicular to the plane. The handle includes a length between the first end of the handle and the second end of the handle, where the rod can be positioned perpendicular to the length of the handle. The moveable portion is configured to rotate about a connection with the base. The base includes a plurality of faces, and the first end of the rod is configured to engage one of the plurality of faces to limit the motion of the moveable portion. Rotation of the rod relative to the moveable member causes the second end of the rod to engage one of the plurality of faces of the base. The rod includes a finger-engageable portion.

Implementations may also include one or more of the following features. For example, the curved member includes a first lateral side and a second lateral side, with the first lateral side opposite the second lateral side; opposing lateral grooves are defined in the first lateral side and the second lateral side; and the moveable member is partially disposed in the opposing lateral grooves. The exercise device includes a plurality of slots defined in one of the opposing lateral grooves, and the moveable member includes a pin configured to engage one of the plurality of slots to limit travel of the moveable member relative to the curved member. The curved member includes markings indicating an orientation of the weight relative to the handle. The weight is positioned collinear with the rod. The weight includes a threaded portion to couple the weight to a second weight. The curved member provides a visual reference to a user of the exercise device to indicate proper alignment of the exercise device. The exercise device includes a visual reference configured to indicate proper alignment of the exercise device.

The details of one or more implementations are set forth in the accompanying drawings and the description below. Other features, objects, and advantages of the disclosure will be apparent from the description and drawings, and from the claims.

DETAILED DESCRIPTION

An exercise device includes adjustment mechanisms that enable the position of one or more weights to be adjusted relative to a handle of the exercise device. The user of the exercise device, through one or more adjustments, can alter the amount of resistance and direction of resistance provided in order to meet the particular needs of the user. For a particular motion or exercise, the resistance characteristics for the motion can be changed by adjusting, for example, the position and/or orientation of the weight. By adjusting, for example, the position of the weight, the user can cause the exercise device to apply resistance over a portion of, or all of, a range of motion for which resistance is needed.

Figure 1A:
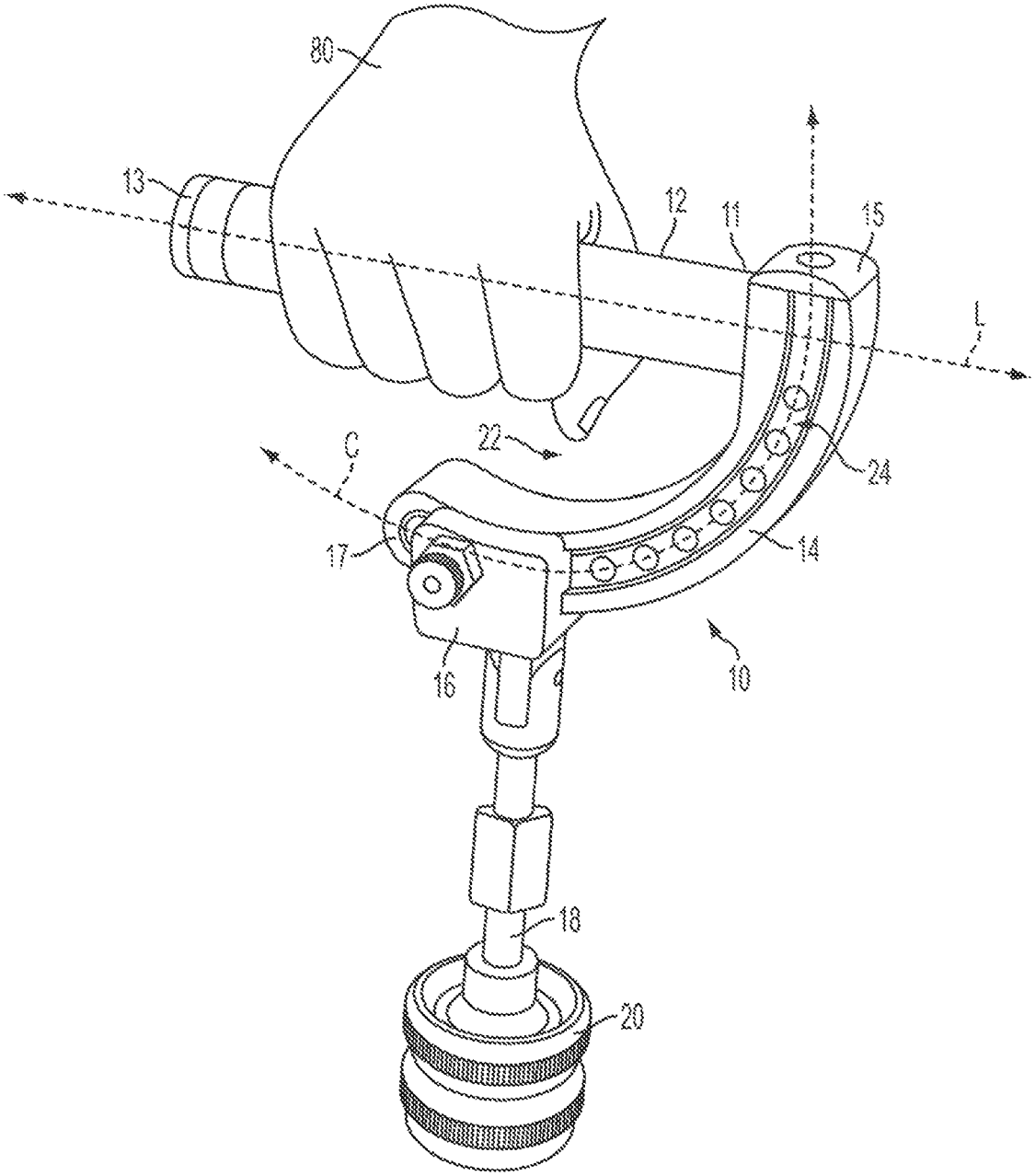
FIGS. 1A and 1B are perspective views of an exercise device.

Now referring to FIG. 1A, an exercise device 10 includes a handle 12 coupled to a curved member 14. The exercise device 10 also includes a moveable member 16, an elongate member 18, and one or more weights 20. The moveable member 16 is attached to the curved member 14 so that the moveable member 16 can move relative to the curved member 14. The elongate member 18 is attached to the moveable member 16. The weights 20 are coupled to the elongate member 18. As described in greater detail below, the curved member 14, moveable member 16, and elongate member 18 allow the position of the weights 20 to be changed relative to the handle 12, enabling the exercise device 10 to be used for a variety of exercises.

To use the exercise device 10, a user 80 can grasp the handle 12 and move the exercise device 10 through a range motions. For example, a user 80 may grasp the exercise device 10 by the handle 12 with one hand and perform one or more movements of the user's hand, wrist, and arm. The user 80 may perform one or more movements including eccentric and concentric (1) flexion, (2) extension, (3) supination, (4) pronation, (5) ulnar deviation and (6) radial deviation.

The handle 12 can include a generally straight length between a first end 11 and a second end 13. The first end 11 and the second end 13 define a central longitudinal axis, L, of the handle 12. The handle 12 can include a grip or surface that assists the user 80 to grasp the handle 12. The handle 12 and the grip of the handle 12 may be replaceable. Accordingly, the user 80 may adjust the handle 12 to simulate the handle of, for example, a tennis racket, a golf club, and other devices by coupling an appropriate handle 12 to the exercise device 10.

The curved member 14 includes a first end 15 and a second end 17 that define a central longitudinal axis, C, of the curved member 14. The curved member 14 can include a curved length between the first end 15 and the second end 17.

Figure 1B:
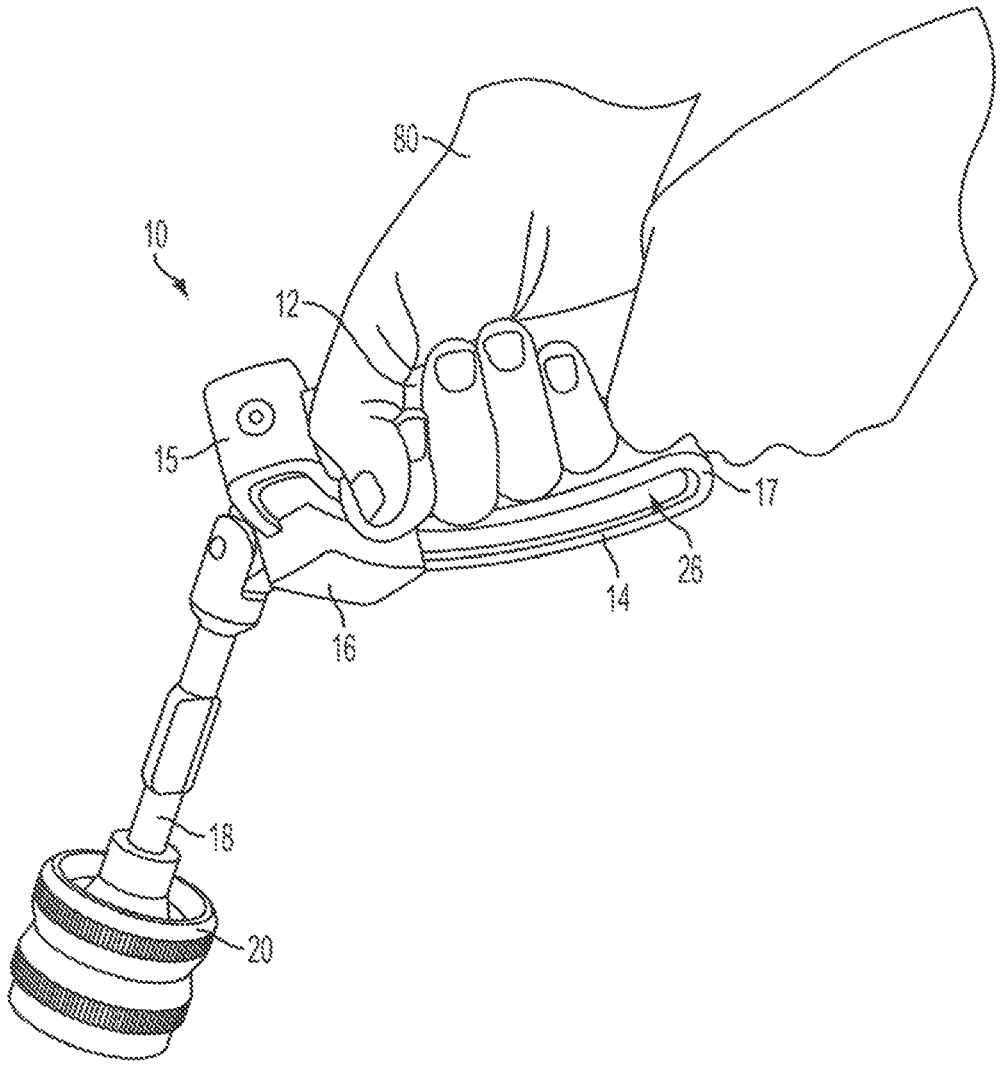

As shown in FIG. 1A, the curved member 14 is attached at its first end 15 to the first end 11 of the handle 12. For example, the first end 15 of the curved member 14 can be coupled to the first end 11 of the handle 12, and the second end 17 of the curved member 14 can remain free. Because the second end 17 of the curved member 14 is free, the user 80 can grasp the handle 12 at the second end 13 of the handle 12, for example, using two hands (FIG. 1B). Additionally, attachment of the curved member 14 at only one end 11 of the handle 12 can facilitate the removal of the handle 12 and replacement with different handles 12, including handles 12 of varying lengths.

The curved member 14 can extend from the handle 12 along a generally convex path relative to the handle 12. Accordingly, a space 22 can be defined between the curved member 14 and the handle 12. For example, the curved member 14 can extend out from the first end 11 of the handle 12 and extend generally toward the second end 13 of the handle 12. The space 22 can accommodate the hand and fingers of the user 80, allowing the user 80 to grasp the handle 12 of the exercise device 10. The length of the curved member 14 can extend from the first end 11 of the handle 12 and can terminate with the second end 17 of the curved member 14 located between the ends 11, 13 of the handle 12.

In one implementation, the curved member 14 can be generally shaped as a segment of a circle that has a diameter of approximately the length of the handle 12. The curved member 14 can form approximately one quarter of the circle, so that the second end 17 of the curved member 14 terminates approximately halfway along the length of the handle 10. Other curvatures and configurations of the curved member 14 are also contemplated.

Figure 2A:
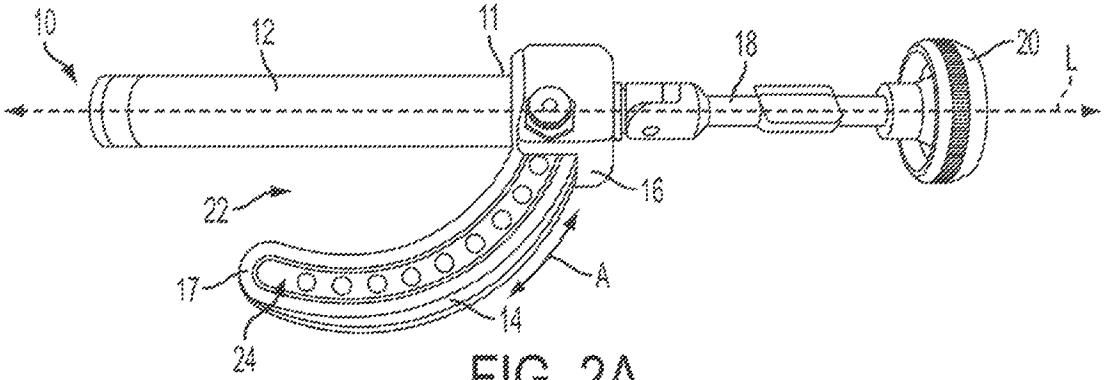
FIGS. 2A to 2C are side views of the exercise device of FIG. 1A.
Figure 2B:
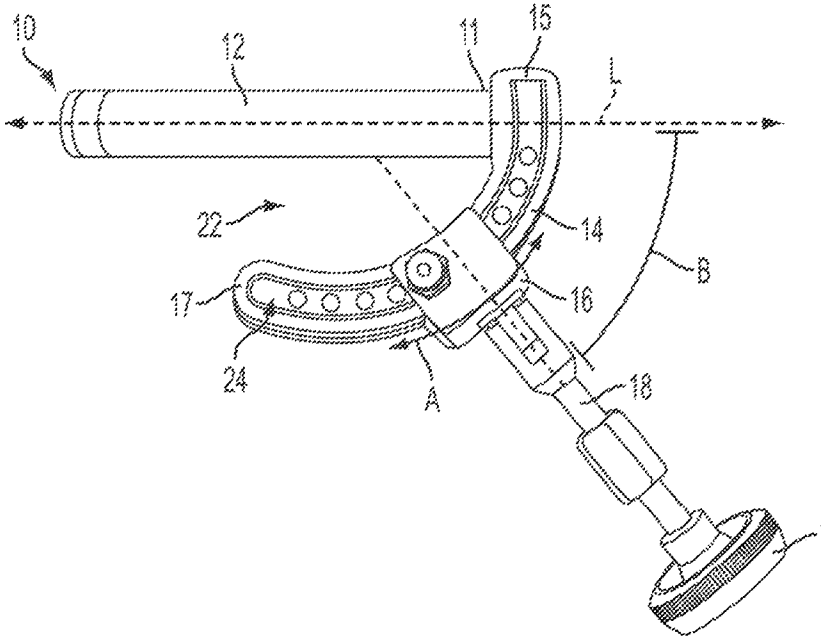
Figure 2C:
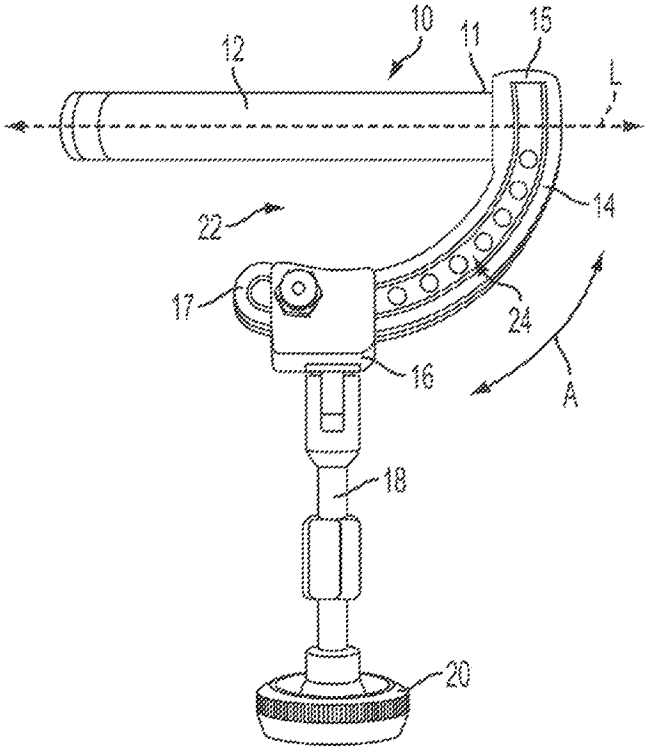

Referring to FIGS. 2A to 2C, the moveable member 16 can be moveably attached to the curved member 14. For example, the moveable member 16 can travel relative to the curved member 14 along a curved path defined by the curved member 14, as indicated by arrow A. Travel of the moveable member 16 relative to the curved member 14 can result in a change in the angle of the moveable member 16 (and also the angle of the elongate member 18 and the weights 20) relative to the handle 12, as shown by angle B of FIG. 28.

Movement of the moveable member 16 relative to the curved member 14 changes the position of the elongate member 18 and the weights 20 relative to both the handle 12 and the curved member 14. In one position of the moveable member 16, the moveable member 16 can be configured with the length of the elongate member 18 generally aligned with the central longitudinal axis of the handle 12 (FIG. 2A). In another position of the moveable member 16 relative to the curved member 14, the moveable member 16 can be configured with the length of the elongate member 18 generally perpendicular to the length of the handle 12 (FIG. 2C). Many other positions are also possible, including the range of positions between those illustrated in FIGS. 2A and 2C.

In one implementation, the central longitudinal axis, L, of the handle 12 and the central longitudinal axis, C, of the curved member 14 define a plane. Movement of the moveable member 16 relative to the curved member 14 results in movement of the elongate member 18, and thus movement of the weights 20, in a direction parallel to the plane defined by the central longitudinal axes C and L.

Figure 3B:
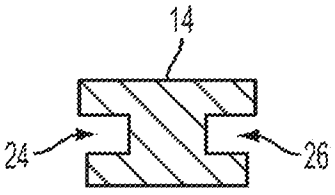
FIG. 3B is a cross-sectional view of the curved member of FIG. 3A.
Figure 3C:
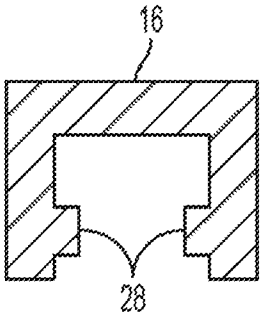
FIG. 3C is a cross-sectional view of a moveable member of the exercise device.
Figure 3A:
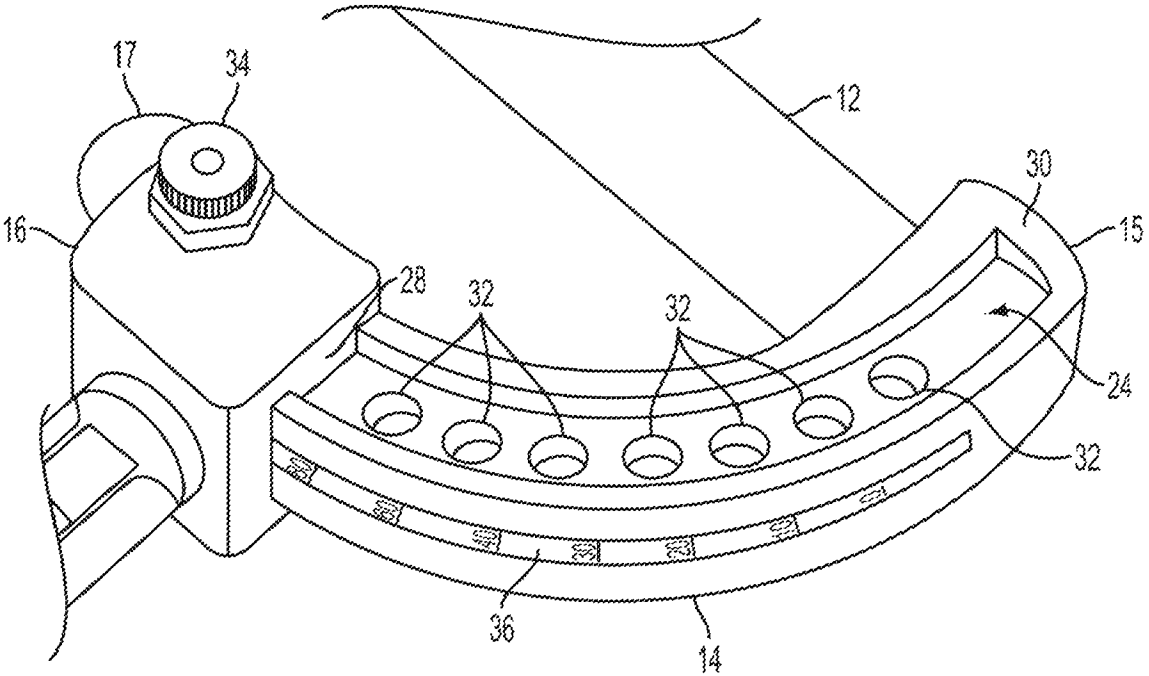
FIG. 3A is a perspective view of a curved member of the exercise device.

The moveable member 16 can be captured about the curved member 14. Referring to FIGS. 3A and 38, grooves 24, 26 can be defined in opposite lateral sides of the curved member 14. The grooves 24, 26 can define a curved path along the length of the curved member 14 that defines the path of travel for the moveable member 16 relative to the curved member 14. A portion of the moveable member 16 can be disposed in each of the grooves 24, 26, and the remainder of the moveable member 16 can be disposed about the curved member 14. For example, the moveable member 16 can include opposing interior rails 28 formed on opposite interior sides of the moveable member 16, with the rails 28 configured to enter and engage the grooves 24, 26 (see FIG. 3C). One end 15 of the curved member 14 may expose the grooves 24, 26 so that the moveable member 16 can initially enter the grooves 24, 26. A cap 30 can be coupled to the end of the curved member 14 to prevent the moveable member 16 from exiting the grooves 24, 26.

An engagement mechanism can be provided to limit the motion of the moveable member 16 relative to the curved member 14. For example, one or more slots 32 can be defined in the groove 24 of the curved member 14. The slots 32 can be disposed in one of the grooves 24, 26 to mark the positions of the moveable member 16 relative to the curved member 14. The moveable member 16 can include a pin 34 that engages one of the slots 32 to limit travel of the moveable member 16 relative to the curved member 14. The moveable member 16 can include a spring or other mechanism to press the pin 34 toward the slots 32 to prevent undesired disengagement of the pin 34 from the slots 32. The user 80 may pull the pin 34 to counteract the force of the spring, allowing the moveable member 16 to move relative to the curved member 14. The user 80 can release the pin 34, and the pin 34 can engage a slot 32 to limit movement of the moveable member 16 relative to the curved member 14.

In one implementation, the engagement of the pin 34 in a particular slot 32 aligns the moveable member 16 relative to the curved member 14 for a particular exercise or rehabilitation therapy. Thus the slots 34 can aid the user 80 to achieve proper configuration and alignment of the moveable member 16 to enable effective exercise or treatment.

The curved member 14 can include markings 36 (see FIG. 4) that correspond to one or more positions of the moveable member 16 relative to the curved member 14. The markings 36 may correspond with positions of the moveable member 16 when the moveable member 16 is engaged with one or more of the slots 32. The markings 36 can indicate to the user 80 a position of the weights 20 relative to the handle 10. For example, the markings 36 may indicate one or more angles of the moveable member 16 relative to the handle 12, such as, for example, angle B of FIG. 28.

Figure 4:
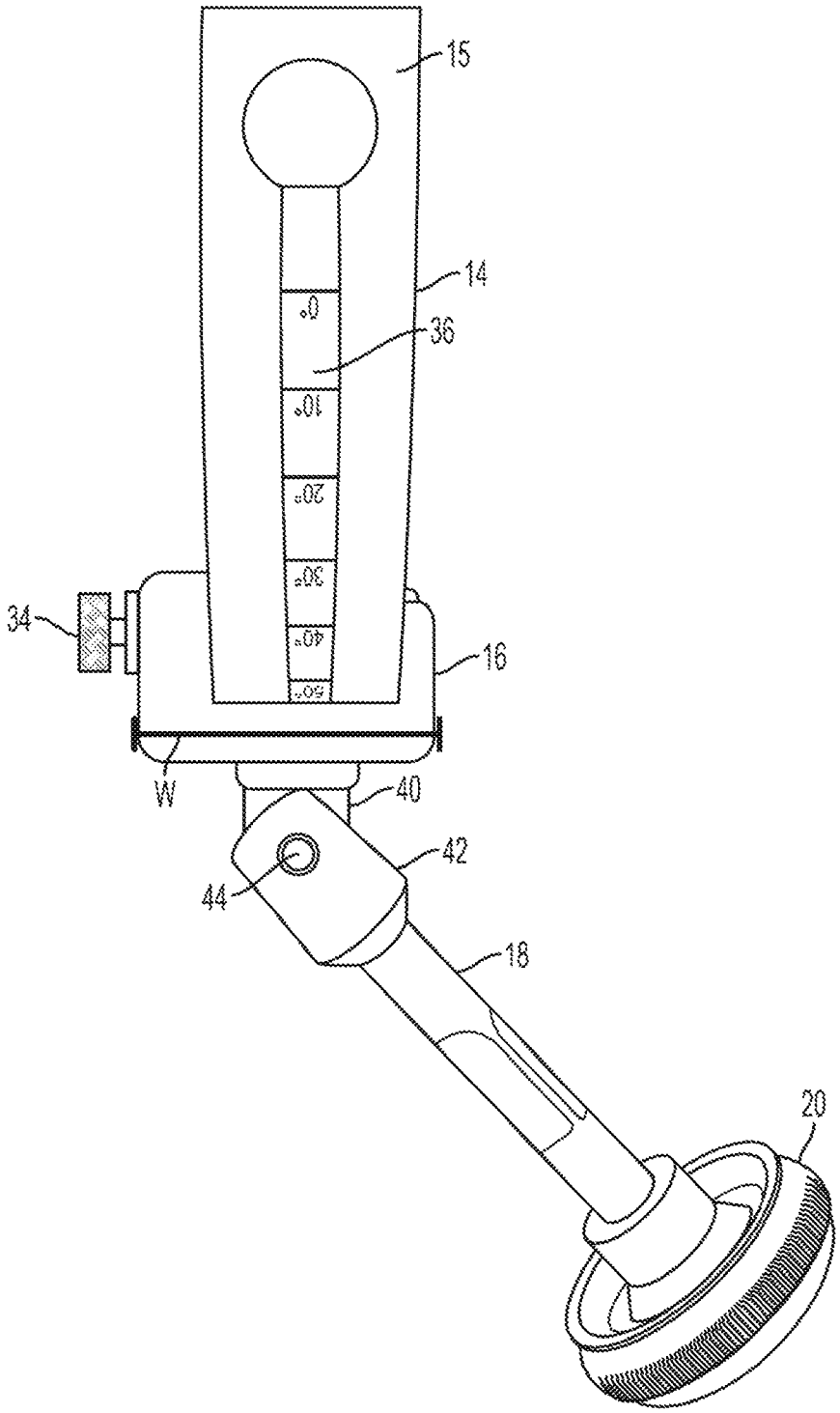
FIG. 4 is an end perspective view of the exercise device.

The moveable member 16 can include a base 40 and a moveable portion 42 configured to move relative to the base 40. As shown in FIG. 4, the moveable portion 42 can be configured to rotate about a connection 44 with the base 40. Rotation about the connection 44 can allow a user 80 to adjust an angle of the elongate member 18 relative to the moveable member 16. In one implementation, the connection 44 can enable a 180-degree range of motion between the moveable portion 42 relative to the base 40 along arrow R. A pin or other connection mechanism can couple the moveable portion 42 to the base 40 and allow motion of the moveable portion 42 relative to the base 40. For example, the moveable portion 42 can be coupled to the base 40 with a hinge that connects the moveable portion 42 to the base 40.

Movement of the moveable portion 42 relative to the base 40 can occur in a direction generally perpendicular to the direction of travel of the moveable member 16 relative to the curved member 14. The movement of the moveable portion 42 relative to the base 40 can be generally perpendicular to a width, W, of the base 40 and can be generally perpendicular to the length of the curved member 14.

The movement of the moveable portion 42 as described above can enable a variety of positions of the weights 20 and the elongate member 18. For example, the movement can enable the elongate member 18 to be positioned perpendicular to the handle 12. In an implementation in which the central longitudinal axis of the handle 12 and the central longitudinal axis of the curved member 14 define a plane, the movement of the moveable portion 42 allows the elongate member 18 to move out of alignment with the plane. In other words, the elongate member 18 can define a central longitudinal axis that can coincide with the plane, and the movement of the moveable portion 42 can move the central longitudinal axis of the elongate member 18 to come out of alignment with the plane. The movement of the moveable portion 42 can similarly enable the weights 20 to be moved out of the plane.

Figure 5:
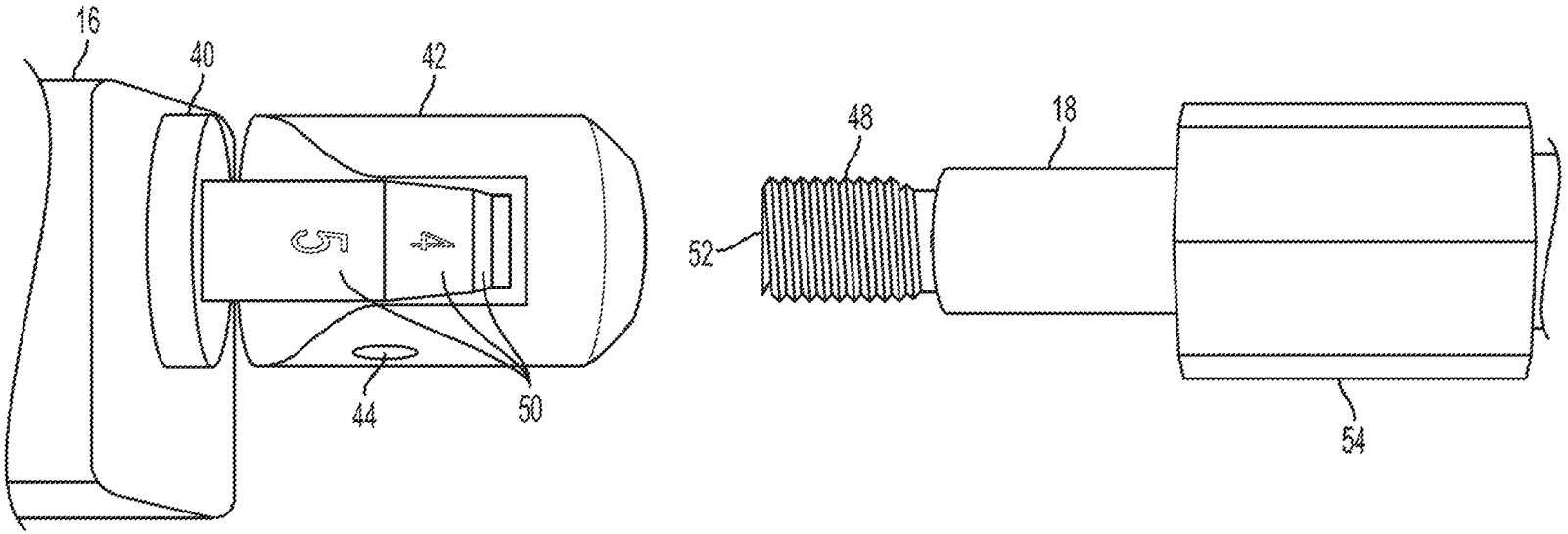
FIG. 5 is a side view illustrating a portion of the moveable member and a portion of an elongate member of the exercise device.

The movement of the moveable portion 42 relative to the base 40 can be limited by engagement of the elongate member 18 with the base 40. Referring to FIG. 5, the moveable portion 42 can define an internal threaded opening (not shown) that receives a threaded end 48 of the elongate member 18. The opening can extend through the moveable portion 42, allowing the end 48 of the elongate member 18 to pass through the moveable portion and contact the base 40.

Figure 6:
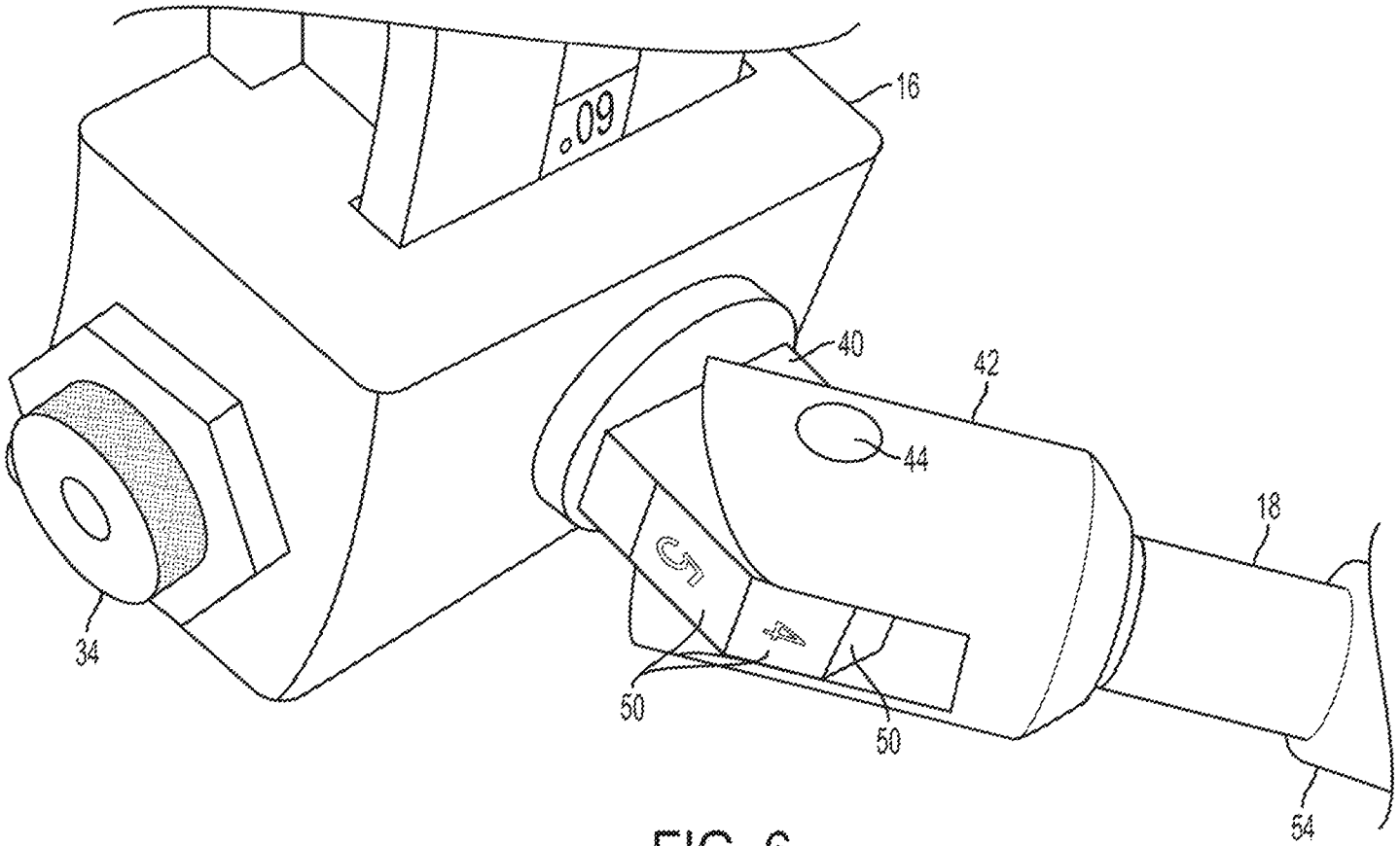
FIG. 6 is a perspective view of a moveable member of the exercise device.

The base 40 includes one or more engagement surfaces 50. For example, the base 40 can include five engagement surfaces 50 that correspond to particular angles of the moveable portion 42 relative to the base 40. The surfaces 50 can be generally flat and can include markings that indicate a particular orientation of the moveable portion 42 relative to the base 40 (see FIG. 6).

The engagement surfaces 50 can be contacted by a generally flat contact surface 52 of the elongate member 18 to limit travel of the moveable portion 42 relative to the base 40. Rotation of the elongate member 18 relative to the moveable portion 42 of the moveable member 16 can cause a contact surface 52 of the elongate member 18 to engage one of the engagement surfaces 50 of the base 40. The contact surface 52 of the elongate member 18 can be generally flat to engage securely with the engagement surfaces 50 of the base 40. Rotation and counter rotation of the elongate member 18 relative to the moveable portion 42 of the moveable member 16 can respectively engage and disengage the contact surface 52 of the elongate member 18 from one of the engagement surfaces 50 of the base 40, allowing the user 80 to move the moveable portion 42 relative to the base 40 and then limit movement when a particular position of the moveable portion 42 has been reached.

Other mechanisms of limiting the motion of the moveable portion 42 relative to the base 40 are also possible. For example, the exercise device can include a control, for example a latch, button, dial, or switch that enables movement of the moveable portion 42 relative to the base 40. The control can disengage a locking mechanism to allow the moveable portion 42 to move relative to the base 40. Using the control, for example by releasing the control or configuring the control in a different orientation, the locking mechanism can be reengaged to secure the moveable portion 42 relative to the base 40. Such an implementation can be used rather than rotating the elongate member 18 to engage and disengage an engagement surface 50. In addition, the moveable portion 42 can be secured relative to the base 40 at any point in the range of motion of the moveable portion 42, and not only at a one of several predefined positions.

The elongate member 18 can be generally straight along its length, and may include, for example, a rod. The elongate member 18 can be detachable from the moveable member 16 (see FIG. 5), allowing one of several different elongate members 18 to be used in the exercise device 10. For example, a user 80 may replace the elongate member 18 with a longer or shorter elongate member to alter the resistance characteristics of the exercise device 10 or a particular exercise. Lengthening the elongate member 18 increases the lever arm of the weights 20 relative to the handle, thus increasing the resistance felt by the user 80 of the exercise device 10. The elongate member can include a finger-engageable portion 54 along the length of the elongate member 18 to facilitate rotation of the elongate member 18 by the user 80.

In an implementation, the length of the elongate member 18 may be adjustable. For example, the elongate member 18 may include a telescoping member. In another implementation, the handle 12 may be configured to receive the elongate member 18 for storage when the exercise device 10 is not in use.

Figure 7:
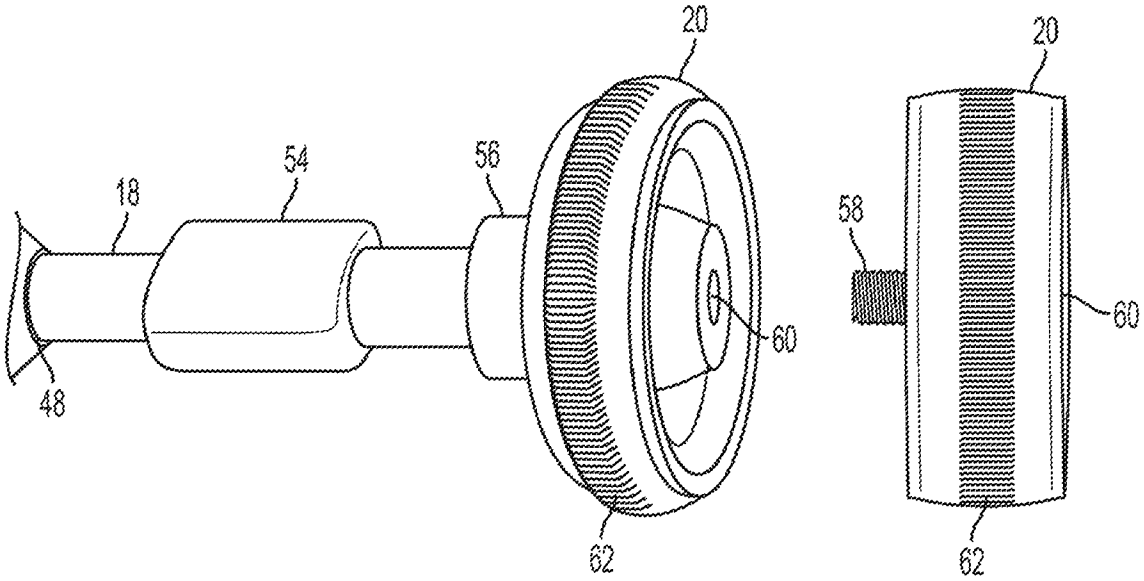
FIG. 7 is a perspective view of the elongate member and weights.

The weights 20 are coupled to the elongate member 18 at an end 56 of the elongate member 18 opposite the threaded end 48 of the elongate member 18. Referring to FIG. 7, the end 56 of the elongate member 18 can include a threaded socket that receives one or more weights 20. The weights 20 can include a threaded extension 58 that engages the threaded socket of the elongate member 18 to couple the weights 20 to the elongate member. In addition, the weights 20 can each include a threaded socket 60 to receive a threaded extension 58 of another weight 20. The user 80 can couple one weight 20 to another weight 20 to couple multiple weights 20 to each other and to the elongate member 18. One or more weights 20 can include a ridged portion 62 formed on an outer surface of the weights 20 to aid the user 80 to grip the weights to engage and disengage the weights from the elongate member 18.

In one implementation, the elongate member 18 and one or more weights 20 can be coupled so that the weights 20 are positioned collinear with the elongate member 18. The weights 20 can be coupled to the elongate member 18 so that a central axis of one or more weights 20 coincides with the central longitudinal axis of the elongate member 18.

The exercise device 10 can include a visual reference to aid the user 80 to maintain correct alignment of the exercise device 10 during use. Because the exercise device 10 can be portable and handheld, it may be difficult at times for a user 80 to align the exercise device 10 properly during a particular motion. Specifically, the user 80 may need to move the exercise device 10 in a range of motion for which the trajectory of the weight 20 is not intuitive.

One or more components and portions of the exercise device can provide a visual reference for alignment of the exercise device 10. For example, the curved member 14 can function as a visual reference to the user 80, assisting the user 80 to guide the motion of the exercise device 10. When the central longitudinal axis of the curved member 14 and the central longitudinal axis of the handle 12 define a plane, the user 80 can determine the alignment of the plane based on the position of the curved member 14. This reference can be especially useful when the user 80 must move the exercise device 10 in a manner that the plane remains perpendicular or parallel to the ground, but the weight 20 is positioned out of the plane. In such a configuration, the weight 20 may exert torque on the handle 12 that the user 80 must resist to gain full benefit of the motion. The position of the curved member 14 or another visual reference can indicate that the user 80 must counteract the torque applied by the weight 20 or otherwise align the exercise device during a range of motion.

Other visual references, including markings, flags, extensions, and other alignment components, can also be included to assist the user 80 to maintain proper alignment of the exercise device 10 throughout a range of motion. For example, the visual references can be configured to be aligned parallel or perpendicular to a motion of the exercise device 10. One or more visual references can also indicate a direction of motion that the exercise device 10 should be moved.

In an implementation, the exercise device 10 can include one or more motorized components to automatically move the moveable member relative to the curved member 14. Rather than requiring the user 80 to manually move the moveable member 16 relative to the curved member 14, a motorized component may perform the adjustment for the user 80. For example, the moveable member can be motorized to travel along the curved member 14. Similarly, the motorized component may secure the moveable member 16 at a particular position so that a pin and slots are not necessary. For example, the curved member 14 may include a ridged surface along its length that can be engaged by a gear of the moveable member 16. The moveable member may include a motor that drives the gear of the moveable member 16 to cause the moveable member to move along the curved member 14. The motor and gear of the moveable member 16 can be configured to move the moveable member 14 along essentially the entire length of the curved member. Alternatively, or additionally, the curved member 14 and the moveable member 16 can include one or more motors, gears, pulleys, belts and other mechanisms to automatically move the moveable member 16 relative to the curved member 14. The exercise device can also include one or more motorized components to move the moveable portion 42 of the moveable member 16 relative to the base 40 of the moveable member 16.

The exercise device 10 can also include a control, for example, a switch, dial, or button, that adjusts the position of the moveable member 16 relative to the curved member 14. A control can also be included to adjust the position of the moveable portion 42 relative to the base 40.

The exercise device 10 can also include a display, for example a liquid crystal display, to present information to the user 80. For example, information about a position of the moveable member 16 relative to the curved member 14 and information about the position of the moveable portion 42 relative to the base 40 can be presented on the display.

The exercise device 10 can also include a power source (for example, a battery), one or more processing devices, control circuitry, and a storage device to control the operation of one or more motors and the display. The processing device, the processing device, the control circuitry, and the storage device can be disposed in or on the handle and/or the curved member to power and control the operation of one or more motors that control the motion of the moveable member 16. For example, the storage device may include instructions which, when executed by the one or more processing devices, activate one or more motors or mechanisms of the exercise device 10. For example, the processing devices can cause the motors to activate by sending control signals that cause one or more motors to move the moveable member 16 relative to the curved member 14. Control signals can also cause one or more motors to move the moveable portion 42 relative to the base 40.

In the storage device, the exercise device 10 may store one or more pre-programmed movements of the moveable member 16. In one implementation, the processing devices can cause the motors to move the moveable member 16 in an oscillating motion along the length of the curved member 14. A user 80 can be instructed to maintain a particular orientation of the weights 20 while the oscillation or other motion occurs to improve the strength and coordination of the user 80.

Other pre-programmed motions can include sporadic motions and motions that are random or unknown to the user 80. In other words, the processing devices can cause the motors to move the moveable member relative to the curved member in a manner that is unpredictable to the user 80. The user 80 can be instructed to attempt to move his or her body throughout a particular motion with the goal of keeping the center of mass of the weights 20 in one or more particular positions relative to the user's body. Predetermined trajectories can follow regular oscillations. Predetermined trajectories can be unknown to the user 80, to train a user's reflexes.

The exercise device 10 can also incorporate one or more sensors, such as accelerometers and/or gyroscopes, at various positions in the exercise device 10. These sensors can provide data to the processing devices, which may be contained in the body of the exercise device 10. The exercise device 10 can be programmed to automatically adjust a predetermined trajectory during an exercise based on this data.

An embodiment of this invention may include a design which incorporates a semicircular arch which connects both ends of a handle, with the arch containing a sled mechanism enabling a sled to traverse the length of the arch and incorporating a track, mechanical lock, and/or electromechanical components to enable a user to attain fixed position(s) of interest for the sled at one or more points throughout the arch, with the sled attached to a variable weight system to provide the user with variable resistance.

Another embodiment may include a design which incorporates a full circular arch, with the handle along the axis of the diameter of the circle made by the circular arch, which contains the sled and variable weight system. Another embodiment may include a design which incorporates several circular and/or semicircular arches which intersect at the handle, which can be positioned along the shared diameter of the intersecting arches I circles, with the arches sharing a common track which enables one or more sleds with their accompanying resistance to traverse a shared track, and cross over at the diameter into the arch of a different circle/semicircle. A design with several arches may also contain "connecting tracks" at various segments throughout the apparatus which connect one or more arches, enabling one or more resistance sleds to more easily traverse to any desired location in a three-dimensional "sphere" of sled locations surrounding a user's fist, and may resemble a "cage" around the user's fist. Such an apparatus could incorporate electromechanical components that enable dynamic repositioning of one or more resistance sleds throughout the semi-spherical or spherical track apparatus. This apparatus could incorporate computer hardware and software which enables a pre-programmed trajectory for one or more resistance sleds throughout the spherical track, which may enable a user to simulate the resistance profile of an occupational activity (such as an athletic swinging of a racket or club, the swinging of a hammer, etc.) experienced by the user's body. Such a "semi-spherical cage-track apparatus" could also incorporate sleds that, instead of incorporating resistance at static or dynamically variable positions throughout the sled, incorporate visual-motor aids, such as a brightly colored flag, which may serve the sole purpose of guiding the users movements. This could reduce the need for professional supervision during exercise. Resistance sleds and visual-motor sleds could be used together within the same apparatus. Sleds may also incorporate various sensors, such as potentiometers and/or accelerometers, to enable data-feedback regarding the device and/or specific component experience during use, and be utilized by a supervising healthcare practitioner at a remote-monitoring station to gauge user experience and provide feedback to the user. This feedback could indeed be in the form of remotely moving of one or more visual-motor sleds and/or any sled in the device. A design may incorporate signals, such as flashing lights of various colors, at various points throughout the semi-spherical cage-track to provide the user with visual-motor feedback. For example, a gyroscopic sensor within the apparatus may provide feedback to a microcontroller and computer system within the device as to the exact three-dimensional orientation of the apparatus. With this information, the device may flash a light at the track location which is in the horizontal plane directly facing the inside of the user's fist, indicating a "starting location". A second light may then flash on the cage-track directly above the user's fist, indicating an "ending location". The device may then signal, for example, via a computerized voice, for the user to actuate the device in such a way that that the two lights meet each other. The "starting location" light may remain fixed, while the "ending location" light dynamically changes as the user actuates the device to remain in the same spot relative to the user—behaving as a visual motor-aid to mark the spot that the user needs to rotate to. This type of visual-motor feedback and guidance can address the important issue of user instruction and monitoring without direct supervision of a trained professional. The above types of apparatuses may incorporate connections to computerized software games which utilize information from both the gaming system and the physical device to dynamically change both the game and/or the device (for example, location of resistance sleds and/or visual-motor aids). For example, a user may be instructed on screen to use a golf putter, and the apparatus may display the starting and ending ranges via visual-motor aids in the form of lights throughout the track based on the range of motion the user should go through for the putt. The software system could also indicate to the user, via lights or other types of audio/visual/tactile feedback, the ballistic force with which a motion was performed, such as a golf drive. The system could instruct the user, based on what form of golf club the user is going to use, to adjust the weight accordingly, and in one embodiment an apparatus could incorporate an adjustable arm on a resistance sled that can increase in length via a telescoping function—enabling an increase in the moment arm of the apparatus. Such an apparatus could incorporate a game wherein the user has to actuate the device in such a way that the goal is to make their "starting light" chase one or more "goal" lights that traverse throughout the semi-spherical cage-track, with or without differential resistance dynamically adjusted during gameplay. An embodiment of this invention may include a design which incorporates an adjustable hinge at the connecting portion between the handle and one or more semi-circular arches, enabling the user to rotate the gripping of the handle in 360 degrees without the arch making contact with the user's forearms.

Although a few implementations have been described in detail above, other modifications are possible. Moreover, other mechanisms of describing the functionality described above may be used. Other components may be added to, or removed from, the described exercise devices. Accordingly, other implementations are within the scope of the following claims.

What is claimed is:

1. An exercise device, comprising:

a handle;

a curved member coupled to the handle;

a movable member coupled to the curved member, the movable member being configured to travel along a length of the curved member;

an elongate member having a first end and a second end, the first end of the elongate member being coupled to the movable member; and a weight coupled to the second end of the elongate member, wherein the handle includes a storage portion configured to receive the elongate member.

2. The exercise device of claim 1, wherein the movable member includes a base and a movable portion, the movable portion is configured to rotate relative to the base, and the first end of the elongate member being coupled to the movable portion.

3. The exercise device of claim 1, wherein the elongate member includes a telescoping member with an adjustable length.

4. The exercise device of claim 1, further comprising:
control circuitry configured to adjust a position of the movable member relative to the curved member.

5. The exercise device of claim 1, further comprising:
one or more motorized components configured to move the movable member relative to the curved member.

6. The exercise device of claim 1, wherein the curved member is curved along the length of the curved member.

7. The exercise device of claim 1, wherein the curved member includes a first end and a second end, the first end of the curved member is coupled to the handle and the second end of the curved member is free.

8. The exercise device of claim 1, wherein
the handle defines a first longitudinal axis between a first end and a second end of the handle,
the curved member defines a second longitudinal axis between a first end and a second end of the curved member,
the first longitudinal axis of the handle and the second longitudinal axis of the curved member define a plane; and
the movable member is configured to move the weight out of the plane.

9. The exercise device of claim 1, wherein the curved member includes a first lateral side and a second lateral side, the first lateral side being opposite the second lateral side, opposing lateral grooves being respectively defined in the first lateral side and the second lateral side, and wherein the movable member is partially disposed in the opposing lateral grooves.

10. An exercise device, comprising:
a handle;
a first member coupled to the handle;
a second member coupled to the first member, the second member being configured to travel along a length of the first member;
a third member having a first end and a second end, the first end of the third member being coupled to the second member; and
a weight coupled to the second end of the third member, wherein the handle includes a storage portion configured to receive the third member.

11. The exercise device of claim 10, wherein the second member includes a first portion and a second portion, the second portion is configured to rotate relative to the first portion, and the first end of the third member being coupled to the second portion.

12. The exercise device of claim 10, wherein the third member includes a telescoping member with an adjustable length.

13. The exercise device of claim 10, further comprising:
control circuitry configured to adjust a position of the second member relative to the first member.

14. The exercise device of claim 10, further comprising:
one or more motorized components configured to move the second member relative to the first member.

15. The exercise device of claim 10, wherein the first member is curved along the length of the first member.

16. The exercise device of claim 10, wherein the first member includes a first end and a second end, the first end of the first member is coupled to the handle and the second end of the first member is free.

17. A device, comprising:
a handle portion;
a connecting portion coupled to the handle portion;
one or more components, the one or more components comprising a first portion and a second portion, the first portion being coupled to the connecting portion, and the first portion being configured to travel along at least a portion of the connecting portion; and
a weight coupled to the second portion of the one or more components, wherein the handle portion includes a storage portion configured to receive the second portion.

18. The exercise device of claim 17, wherein the second portion is configured to rotate relative to the first portion.

19. The exercise device of claim 17, further comprising:
control circuitry configured to adjust a position of the first portion relative to the connecting portion.

20. The exercise device of claim 17, further comprising:
one or more motorized components configured to move the first portion relative to the connecting portion.

* * * * *